United States Patent [19]

Russell

[11] 4,189,929

[45] Feb. 26, 1980

[54] AIR CONDITIONING AND DEHUMIDIFICATION SYSTEM

[75] Inventor: Lillard G. Russell, Salisbury, N.C.

[73] Assignee: W. A. Brown & Son, Inc., Salisbury, N.C.

[21] Appl. No.: 885,967

[22] Filed: Mar. 13, 1978

[51] Int. Cl.[2] ..... F25D 17/04

[52] U.S. Cl. ..... 62/175; 62/176 D; 62/229

[58] Field of Search ..... 62/90, 93, 176 D, 176 E, 62/176 B, 228 C, 175, 229

[56] References Cited

U.S. PATENT DOCUMENTS

| | | | |
|---|---|---|---|
| 2,289,923 | 7/1942 | Miller | 62/176 X |
| 2,461,602 | 2/1949 | Newton | 62/229 X |
| 4,018,584 | 4/1977 | Mullen | 62/175 |

*Primary Examiner*—William E. Wayner

*Attorney, Agent, or Firm*—Richards, Shefte & Pinckney

[57] ABSTRACT

Two air conditioning compressors connected in parallel supply an evaporator suitably valved for operation at full capacity with both compressors for maximum normal comfort cooling, for operation at half capacity with one of the compressors for half capacity normal comfort cooling, and for operation at three-quarter capacity with both compressors for maximum dehumidification of the treated air without frosting the evaporator. Waste heat from a refrigerant compressor may be used to reheat the air during the dehumidification operation.

13 Claims, 2 Drawing Figures

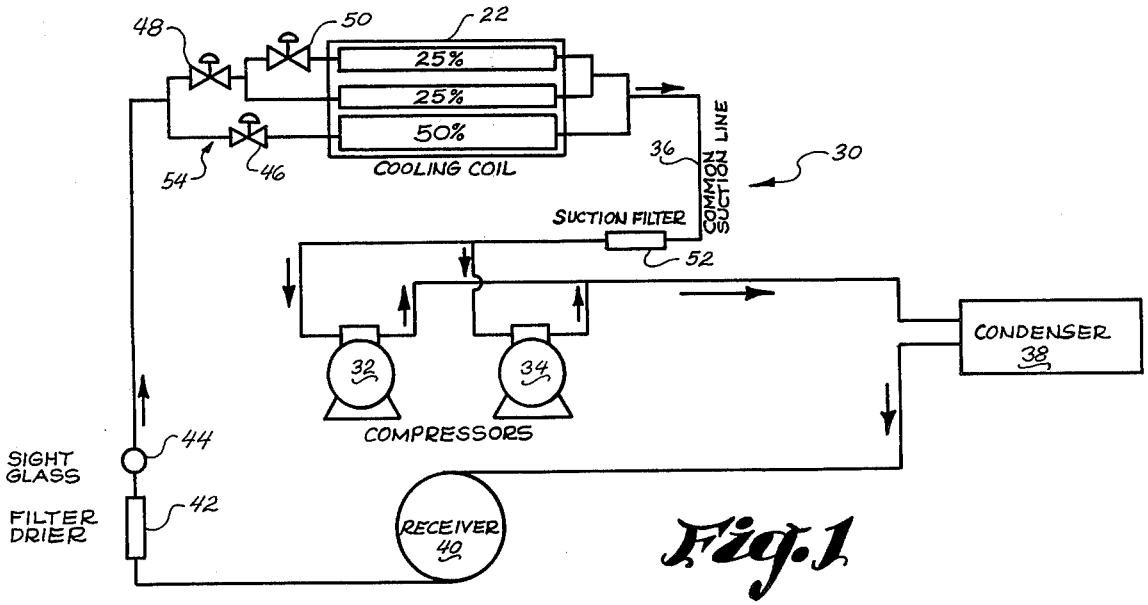
Fig. 1
Fig. 2
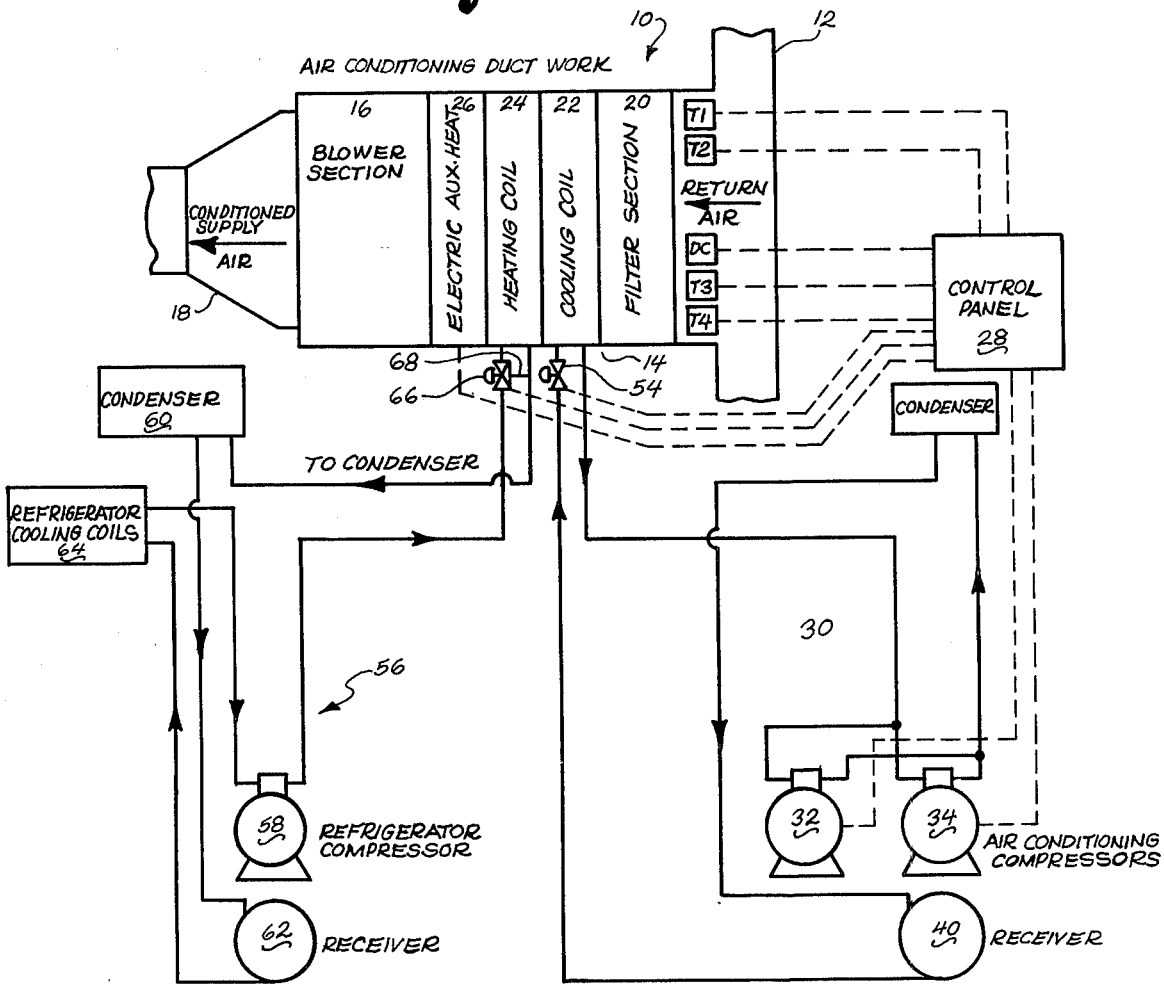

AIR CONDITIONING AND DEHUMIDIFICATION SYSTEM

BACKGROUND OF THE INVENTION

Many prior art attempts to tailor compressor and evaporator capacity to the cooling and dehumidification requirements of an air conditioned space have consisted of systems where parallel separate circuits contained essentially duplicate systems of compressors, evaporators, condensers, and other auxiliary equipment. In some cases, dehumidification has been achieved by using the full capacity of an evaporator while operating with more compressor capacity than is used in normal comfort cooling operation with the full capacity of the evaporator, which results in a portion of the compressor capacity which is used only in the dehumidification phase of the operation. At least one commercial available air conditioner, Yorkaire conditioners Models 351 and 551, manufactured by the York Corporation, York, Pennsylvania, in 1950, was equipped with a valve which cut off the refrigerant from half the evaporator coils so that the entire compressor output was concentrated in the other half of the evaporator coil and thereby cooled the evaporator sufficiently for dehumidification. However, it is reported that this evaporator operated at such a low temperature that the evaporators were constantly freezing up solid because their surface temperature dropped below 32° F.

U.S. Pat. No. 4,018,584 discloses three embodiments which appear to capsule the prior art. The first embodiment, as best shown in FIG. 2, comprises two compressors, at least one of them a multi-capacity compressor, in separate, but generally parallel refrigerant circuits, providing for both cycling and continuous operation of each compressor, and for high and low capacity operation of the multi-capacity compressor, but always in conjunction with the full capacity of the refrigerant evaporator associated with the operative compressor. This embodiment provides for various operating modes depending upon conditions sensed in the conditioned space, such as full capacity operation of the multi-capacity compressor circuit for dehumidifying, low capacity compressor operation in the multi-capacity compressor circuit plus continuous operation of the other compressor circuit for maximum comfort cooling without dehumidification, and cycling of one or both of the compressors in comfort cooling mode for lesser comfort cooling capacity.

A second embodiment disclosed in U.S. Pat. No. 4,018,584 at column 5, lines 18–30, includes a two speed compressor in a refrigerant circuit utilizing the complete capacity of its evaporator to provide dehumidification or comfort cooling depending on whether the compressor runs at its high or low speed respectively. A third embodiment disclosed at column 5, lines 31–36, provides a fixed capacity compressor and an evaporator therewith which is appropriately valved for operation at full capacity for comfort cooling and for operation at a suitable portion of capacity to provide a colder evaporator and dehumidification thereby.

None of the above embodiments, however, provides the flexibility and adaptability inherent in the system of the present invention, where two compressors in parallel may be used with the entire capacity of the evaporator for maximum comfort cooling, either of the compressors may be used with a corresponding portion of the capacity of the evaporator for a reduced comfort cooling capacity, and both compressors may be used at full capacity with a suitably somewhat reduced portion of the evaporator capacity for dehumidification substantially without evaporator frosting.

The flexibility and adaptability of the present invention are particularly important in connection with the air conditioning and dehumidification of supermarkets, where a variety of refrigeration units, such as deep freeze units, meat display cabinets, and dairy product cases, each have cooling coils which are subject to frosting up from the ambient air moisture content and must be defrosted with regularity. These cooling coils also may lower the temperature of the supermarket to an uncomfortable point for the customers, particularly when the air conditioning system is used for dehumidification in spring and fall when cooling of the air may not be required otherwise, thus requiring that the air supplied be heated at times. Dehumdification of the supermarket atmosphere on a controlled basis provides significant savings in auxiliary heat required to defrost the various freezer and refrigerator cooling coils, as well as preventing condensation or frosting around the openings thereto, and promoting more efficient operation of the freezer and refrigerator cooling coils by minimizing the amount of front on their coils. Frost on the coils interferes with their cooling capacity, particularly where the coils must be maintained far below the freezing point of water, as in deep freeze cases. In the present system, otherwise waste heat which must be removed from compressed refrigerant before evaporation for cooling, may be used to reheat the treated air after dehumidification.

U.S. Pat. Nos. 3,596,474, 2,522,090, 4,003,729, and 3,703,814 provide other background for this invention. (Copies of the just-listed U.S. Patents and U.S. Pat. No. 4,018,584 plus a copy of *Yorkaire Conditioners Models* 351 and 551 *Service Manual Instruction* 11-0-5 are enclosed herewith.)

SUMMARY OF THE INVENTION

The air conditioning and dehumidifying system of the present invention provides means for compressing refrigerant selectively operable at generally full and reduced capacities, means for evaporating refrigerant having means for selectively operating at generally full and reduced capacities, means for directing compressed refrigerant from the compressing means to the evaporating means for evaporation therein, and means for controlling the compressing means and the selectively operating means selectively responsive to the temperature and moisture content of air ambient to the evaporating means fo selectively operating the compressing means at full capacity and the evaporating means at full capacity for substantially maximum comfort cooling without substantial dehumidifying of the ambient air, operating the compressing means at a reduced capacity and the evaporating means at a corresponding reduced capcity for correspondingly reduced comfort cooling of the ambient air, and operating the compressing means at full capacity and the evaporating means at a reduced capacity for substantially maximum dehumidifying of the ambient air without substantial frosting of the evaporating means. Means is provided for reheating the ambient air with waste heat from refrigerant during maximum dehumidifying, and means responsive to the ambient air temperature is provided for directing the waste heat to the reheating means when required for comfort heating.

Further described, the invention provides for the reduced capacity of the evaporating means for maximum dehumidifying to be greater than the aforesaid corresponding reduced capacity of the evaporating means for correspondingly reduced comfort cooling, a pair of refrigerant compressors comprises the means for compressing refrigerant, and the means for directing refrigerant from the compressing means comprises means for directing compressed refrigerant from each of the compressors independently to the evaporating means. The means for controlling the compressing means and the means for selectively operating the evaporating means includes means for controlling the compressors for selectively operating both compressors and operating the evaporating means at full capacity for substantially maximum comfort cooling, for operating one of the compressors only and operating the evaporating means at the corresponding reduced capacity for correspondingly reduced comfort cooling, and for operating both the compressors and operating the evaporating means at the reduced capacity for substantially maximum dehumidifying, the reduced capacity of the evaporating means for maximum dehumidifying being greater than the aforesaid corresponding reduced capacity of the evaporating means for correspondingly reduced comfort cooling. The evaporating means comprises a cooling coil for the ambient air having a plurality of circuits communicating with the compressing means for reception of refrigerant therefrom for normal comfort cooling of the air at full capacity of the compressing means, and means for selectively varying the number of the circuits communicating therewith.

In a preferable embodiment of the invention, the reduced capacity of the compressing means and the compressors of substantially equal capacities comprises operating one of the compressors only for substantially half capacity of the compressing means, and operating the evaporating means at the corresponding capacity comprises substantially half capacity for reduced comfort cooling of substantially half capacity. Operating the compressing means or compressors and the evaporating means for maximum dehumidifying comprises operating both compressors for full capacity of said compressing means and operating the evaporating means at reduced capacity for maximum dehumidifying which comprises operating the evaporating means at substantially three-quarter capacity. The means for controlling the compressing means and the means for selectively operating the evaporting means includes means responsive to two different temperature level ranges of the ambient air for selectively operating the compressing and evaporating means for reduced comfort cooling when responsive to the lower of the temperature level ranges and for maximum comfort cooling when responsive to the higher of the temperature level ranges, and also includes an overriding control means responsive to a predetermined value of the moisture content of the ambient air for selectively operating the compressing and evaporating means for maximum dehumidifying when the moisture content is at or above the predetermined value thereof, overriding the temperature level range responsive means. Preferably, the means for selectively varying the number of cooling circuits communicating with the compressing means includes a first valve for blocking a portion of the circuits from communicating, and a second valve for likewise blocking a larger portion of the circuits than the first valve.

In the preferred embodiment of the invention, the first blocking valve is disposed in the cooling coil circuits to block substantially 25% of them, and the second valve is disposed therein to block substantially 50% of them. It is preferred for the evaporating means to operate at a surface temperature of about 45° to 47° F. during comfort cooling and at a surface temperature of about 34° to 35° F. during maximum dehumidifying.

DESCRIPTION OF THE DRAWINGS

FIG. 1 is a schematic diagram showing basic components of the refrigerant circuit of the preferred embodiment of the air conditioning and dehumidifying system of the present invention; and FIG. 2 is a schematic circuit diagram showing basic components of the entire air conditioning, dehumidification, air heating, and refrigeration system plus the controls therefor, of the preferred embodiment of the present invention.

DESCRIPTION OF THE PREFERRED EMBODIMENT

An air conditioning and dehumidification system especially suitable for a supermarket must have flexibility and adaptability of operation and control to accommodate widely varying conditions from those of summer when makeup and return air may be very hot and humid and the cooling load from the building space very high, to those of mid-winter when makeup air may be very cold and dry and heating of the building is required, and perhaps the most troublesome seasons in spring and fall when the humidity of the ambient air may be very high and little or no heating or cooling of the building for customer comfort is required. Significant savings in operating costs of the refrigerated display cases in the supermarket may be made by controlling the humidity of the supermarket atmosphere to a reasonably low moisture content consistent with customer comfort and thereby controlling the amount of moisture available for condensation and frosting on the cooling coils of the refrigerated display cases, where it insulates the cooling coils from air ambient thereto, interferes with air flow, and reqires frequent defrosting, all deleterious to the efficiency of the refrigerating apparatus. Controlled humidity may therefore improve refrigerating efficiency so that less in-place refrigerating capacity is required, cutting investment cost as well as operating cost. Also, certain initial investment savings may be made in such a humidity controlled supermarket by eliminating the need for heating coils around the doors of refrigerated display cases which are otherwise required to prevent undesirable condensation from forming thereon.

The arrowed solid lines of FIGS. 1 and 2 represent the conventional pressure tubing commonly used in air conditioning and refrigeration circuits, the arrows indicating refrigerant flow direction. FIG. 2 shows a complete air conditioning, dehumidifying, and heating system in connection with a refrigerator system, as most suitable for low first cost and low continuing operating costs of the systems in a supermarket. Air conditioning duct work 10 provides means for evacuating large quantities of air from the air conditioned space in a supermarket building through return air ductwork 12, passing this return air through a treating section 14, through a blower section 16, and back into the air conditioned spaces of the supermarket building through conditioned supply air ductwork 18 which suitably distributes newly conditioned supply air out over the reaches of the supermarket.

The return air in its ambient passage through the treating section 14 passes first through a conventional filter section 20 for removal of dust and dirt particles, through a cooling coil or evaporator section 22 for cooling the ambient air as required, and through a heating coil section 24 and an electric auxiliary heat section 26 for heating the ambient air as required before passage through the blower section 16 and back into the supermarket.

A control panel 28 shcematically represents a controlling means which gathers data on the temperature and moisture content of the ambient return air from sensing devices which may conveniently be disposed in the return air ductwork 12, is selectively responsive thereto, and performs conventional logic functions on the gathered data and generates control signals therefrom for controlling the operation of an air conditioning compressing means, and an evaporating means and reheating means comprising the cooling and heating sections of the air conditioning ductwork. Data gathering and control connections are schematically indicated by the broken lines in FIG. 2 and are conventional in nature, and the data gathering sensing devices may be alternatively placed in the air conditioned space of the supermarket.

An air conditioning and dehumidification refrigerant circuit, as generally indicated by the numeral 30, is composed of conventional elements arranged in a novel configuration for this preferred embodiment of the present invention.

As best shown in FIG. 1, a pair of refrigerant compressors 32 and 34 of generally equal capacity forms a means for compressing refrigerant selectively operable at generally full and reduced capacities represented by operating both or only one of the compressors according to signals from the controlling means therefor formed by the control panel 28, and have their respective intakes and outputs connected independently in parallel to a common suction line 36 and to a common condenser 38. Compressed and liquefied refrigerant flows from the compressing means through directing means including connecting tubes, a condenser 38, a receiver 40, a filter dryer 42, and a sight glass 44, for evaporation in a refrigerant evaporating means including refrigerant control valves 46, 48, and 50, and the cooling coil or evaporator section 22. The liquefied refrigerant is evaporated and expanded within the cooling coil 22 to extract heat from the air circulated thereover, and the gasefied refrigerant is returned through a common suction line 36 containing a suction filter 52 to the refrigerant compressors 32 and 34. The evaporator or cooling coil 22 conventionally includes a plurality of convolutions or circuits of tubing communicating with the compressing means for reception of refrigerant therefrom and arranged for passage of air thereover and therebetween, and the multiple tubes are manifolded in this preferred embodiment into three different sections incorporating 50%, 25%, and 25%, respectively, of the full capacity or full tube circuit capacity of the evaporator section 22.

Refrigerant control valves 46, 48, and 50 are solenoid valves which either pass or block off the flow of refrigerant through the tube runs in which they are connected and form means for selectively operating the evaporating means at generally full and reduced capacities as determined by the controlling means therefor formed by the control panel 28. The valve 46 controls flow through the 50% tube circuit capacity section, the valve 48 through both 25% capacity sections, and the valve 50 through one of the 25% capacity sections. The three valves 46, 48, and 50 are indicated in FIG. 2 as combined into a valve complex 54 for clarity, are electrically connected to the control panel 28 as indicated by the broken line extending therebetween and form means for selectively varying the number of tubing circuits communicating with the compressing means.

A typical refrigerating system is indicated by the numeral 56 in FIG. 2 and includes a conventional refrigerator compressor 58, condenser 60, receiver 62, and refrigerator cooling coils 64. The heating coil 24 is selectively included in the refrigerating system 56 by a heating refrigerant control valve 66, which is also electrically connected to the control panel 28 by the broken line connection therebetween to form means responsive to ambient air temperature for directing the waste heat from refrigerant to a means for reheating the ambient air when required for comfort heating. The valve 66 has the capability to pass compressed refrigerant straight through from the compressor 58 to the heating coil 24 for passage therethrough to the condenser 60, or in its other mode of operation to cut off flow to the heating coil 24 and pass the refrigerant from the compressor 58 through a by-pass connection 68 straight to the condenser 60 without passing through the heating coil 24. This provides for the convenient use of waste heat from the compressed refrigerant in the refrigerating system 56 for at least partially heating or reheating the supermarket air ambient to the coil 24 as desired, and the electric auxiliary heat section 26 provides additional heat as required during extreme cold weather. Waste heat from the compressed refrigerant in the air conditioning system may be used similarly if desirable.

In the normal operation of such a system, the blower section 16 is in constant operation to keep air moving, mixed, and circulating throughout the air conditioned spaces of the supermarket building to prevent any stagnation or stratification which might create undesirable atmosphere conditions. A typically desirable supermarket atmosphere might be a temperature of 70°–72° F. and 40 grain moisture content per pound of dry air, and under such conditions only the blower 16 would operate until either temperature or moisture content changed. Typically, the temperature might rise above 72° F., at which point a preset thermostat means T1 signals the control plane 28 to open the valve 46 and close the valve 48 for operating the evaporting means at half or reduced capacity and to start the air conditioning compressor for corresponding half or reduced capacity compressor means operation for operation of the refrigerant system at half or correspondingly reduced capacity in a comfort cooling mode of operation where essentially only sensible heat is removed from the ambient air and substantially no latent heat is removed by dehumidifying or condensing moisture out of the air onto the cooling coils 22, which preferably operate at a surface temperature substantially in the range of 45°–47° F. during comfort cooling. If this amount of comfort cooling capacity proves sufficient to again lower the return air temperature to 72° F., the thermostat means T1 signals the control panel 28 to stop the compressor 32. If an increasing heat load causes the return air temperature to rise above say 74° F. a preset thermostat means T2 signals the control panel 28 to open the valves 48 and 50 and additionally turn on the air conditioning compressor 34 so that the system may operate at 100% or full compressor capacity and 100% or full cooling coil tube capacity for a maximum amount of comfort cooling without substantial dehumidifying of the ambient air.

Operation at 100% comfort cooling capacity continues until the return air temperature drops to 74° F., at which point the thermostat means T2 signals the control panel 28 to return the system to 50% comfort cooling capacity operation on the basis of the continuing signal from the thermostat means T1. Thus the thermostat means T1 and T2 comprise means responsive to two different temperature level ranges of the ambient return air.

Assuming that outdoor air conditions are so cold that cooling by the air conditioning system is no longer necessary, the temperature of the return air may drop to 72° F. and upon loss of the signal from the thermostat means T1, the control panel 28 halts the operation of the air conditioning compressor 32. And upon further dropping of the ambient return air temperature to the setting of a thermostat means T3, say 70° F., the resulting signal from the thermostat means T3 causes the control panel 28 to actuate the valve 66 to allow hot refrigerant from the refrigerator compressor 58 to circulate through the heating or reheating means or coil 24 to warm the air passing through the treating section 14. If the hot refrigerant does not supply enough heat and the return air temperature continues to drop to the setting of a thermostat means T4, say 68° F., then the signal from the thermostat means T4 causes the control panel 28 to additionally turn on the electric auxiliary heat 26 in the treating section 14 until such time as the return air temperature rises above 68° F., whereupon loss of the signal from the thermostat means T4 causes the control panel 28 to turn off the auxiliary heat 26, so that heat is supplied only by the heating coil 24 so long as the thermostat means T3 signals a temperature of 70° F. or below. If the heat from the coil 24 is sufficient to raise the temperature of the return air above 70°, the thermostat means T3 no longer signals the panel 28 and the system returns to its neutral state with only the blower section 16 operating.

A dew point controller DC such as a Honeywell Dew-point Controller H609A is also located in the return air ductowrk 12 where it senses the actual moisture content in the return air and is connected to control panel 28 to comprise an overriding control means over the thermostat means T1 and T2, the air conditioning compressors 32 and 34, and the valves 46, 48 and 50. Typically, the dew point controller DC is preset to signal the panel 28 when the moisture content of the return air rises above a predetermined value of 40 grains per pound of dry air, and the panel 28 thereupon uses the signal from the dew point controller DC to cause the valves 46 and 48 to operate open and the valve 50 to operate closed and to turn on both air conditioning compressors 32 and 34, regardless of whatever signals may be received from the thermostat means T1 and T2. The refrigerant circuit 30 then operates in its dehumidification mode, with 100% or full compressor capacity operation and 75% or reduced cooling coil tube capacity which lowers the surface temperature of the active portion of the cooling coil 22 substantially to the 34°-35° F. range. In that temperature range a maximum amount of moisture will be condensed onto the cooling coils from the ambient air flowing by without substantial frosting of the coils, and this operational mode will continue until the actual moisture content of the return air as sensed by the dew point controller DC drops to 40 grains per pound of dry air or less. Since this dehumidification mode of operation may well occur under conditions where the temperature of the return air is not calling for air cooling by signals from the thermostat means T1 or T2, and the thermostat means T3 or T4 may be calling for heat, the control panel 28 is suitably programmed so that a signal from the thermostat means T3 will cause the panel 28 to actuate the valve 66 to pass heated refrigerant through the heating coil 24 for reheating the just-dehumidified air passing therethrough so long as indicated desirable by a continuing signal from the thermostat means T3 as previously described.

A control panel 28 in the form of a conventional Honeywell Supermarket Environmental Panel Model W960B may use signals from a single thermostat means such as represented by T1 in FIG. 2 in the form of a conventional Honeywell Model T7047C1025 Electronic Thermostat in order to create the signals for controlling the compressing, evaporating, and heating means as above-described without the need for the thermostat means T2, T3 and T4 used in the preceding explanation to explain simply the function of the apparatus.

Thus, the air conditioning and dehumidification system of the preferred embodiment of the present invention provides for fixed capacity compressors for simplicity and most efficient operation, as well as providing a certain safety factor in that failure of one compressor does not put the whole system out of commission, as would be true in a system where a single multi-capacity type compressor is used; however, a single multiple-capacity compressor may be used in the present invention so long as it is suitably connected and controlled for full and reduced capacity operation selectively as previously described. The present system provides for full capacity compressor operation for both comfort cooling and dehumidification modes of operation, whereas prior art systems with dual refrigerant circuits and cne or more dual capacity compressors operated with full compressor capacity for dehumidification, but not for comfort cooling, with resulting inefficiency.

Some prior art systems employing a single refrigerant circuit with a dual capacity compressor, perform as just mentioned in that surplus compressor capacity exists during comfort cooling, and no partial capacity comfort cooling is provided. Other prior art systems used a fixed capacity compressor and suitably valved evaporator or cooling coil means to provide full capacity compressor operation for both comfort cooling and dehumidification, but no partial capacity comfort cooling was available.

Therefore, the system of the present invention is novel in providing for full capacity compressor operation in both comfort cooling and dehumidification modes, and provides as well for partial capacity comfort cooling from an efficient fixed capacity compressor, all within one refrigerant circuit, with resultant economies in both first cost and operating cost.

The particular embodiment disclosed in full detail herein and illustrated in the drawings has been provided for system disclosure purposes only and broadly discloses conventional commercial equipment elements which may be subject to many detail variations, and this embodiment is not intended to limit the scope of the present invention, which is to be determined by the scope of the appended claims.

I claim:

1. An air conditioning and dehumidification system comprising:

(a) means for compressing refrigerant and selectively operable at generally full and reduced capacities;

(b) means for evaporating refrigerant and having means for selectively operating at generally full and reduced capacities;

(c) means for directing compressed refrigerant from said compressing means to said evaporating means for evaporation therein; and (d) means for controlling said compressing meand and said means for selectively operating said evaporating means selectively responsive to the temperature and moisture content of air ambient to said evaporating means for selectively:

(aa) operating said compressing means at full capacity and said evaporating means at full capacity for substantially maximum comfort cooling without substantial dehumidifying of said ambient air, (bb) operating said compressing means at a reduced capacity and said evaporating means at a corresponding reduced capacity for corresponding reduced comfort cooling of said ambient air, and (cc) operating said compressing means at full capacity and said evaporating means at a reduced capacity for substantially maximum dehumidifying of said ambient air without substantial frosting of said evaporating means.

2. An air conditioning and dehumidifying system according to claim 1 and characterized further in that said reduced capacity of said evaporating means for maximum dehumidifying is greater than said corresponding reduced capacity of said evaporating means for correspondingly reduced comfort cooling.

3. An air conditioning and dehumidifying system according to claim 1 and characterized further in that said reduced capacity of said compressing means comprises substantially half-capacity, said selectively operating said evaporating means at reduced capacities comprises operating at substantially three-quarter and half capacity, said operating said compressing means and said evaporating means for reduced comfort cooling comprises operating said means respectively at substantially half capacity each for substantially half capacity comfort cooling, and said operating said compressing means and said evaporating means for maximum dehumidifying comprises operating said evaporating means at substantially three-quarter capacity.

4. An air conditioning and dehumidifying system according to claim 1 and characterized in that said means for compressing refrigerant comprises a pair of refrigerant compressors, said means for directing refrigerant from said compressing means comprises means for directing compressed refrigerant from each of said compressors independently to said evaporating means for evaporation therein, and said means for controlling said compressing means and said means for selectively operating said evaporating means comprises means for controlling said compressors for selectively operating both said compressors and operating said evaporating means at said full capacity for substantially maximum comfort cooling without substantial dehumidifying, operating one of said compressors only and operating said evaporating means at said corresponding reduced capacity for correspondingly reduced comfort cooling, and operating both said compressors and operating said evaporating means at said reduced capacity for said substantially maximum dehumidifying of said ambient air without substantial frosting of said evaporating means.

5. An air conditioning and dehumidifying system according to claim 4 and characterized further in that said reduced capacity of said evaporating means for maximum dehumidifying is greater than said corresponding reduced capacity of said evaporating means for correspondingly reduced comfort cooling.

6. An air conditioning and dehumidifying system according to claim 4 and characterized further in that said compressors are of substantially equal capacities, said operating one of said compressors only and operating said evaporating means at said corresponding reduced capacity comprises operating said evaporating means at substantially half-capacity, and said operating both said compressors and operating said evaporating means at said reduced capacity for said substantially maximum dehumidifying comprises operating said evaporating means at substantially three-quarter capacity.

7. An air conditioning and dehumidifying system according to claim 1 and characterized further in that said controlling means includes means responsive to at least two different temperature level ranges of said ambient air for said selectively operating said compressing means and evaporating means for said reduced comfort cooling when responsive to the lower of said temperature level ranges and for said maximum comfort cooling when responsive to the higher of said temperature level ranges.

8. An air conditioning and dehumidifying system according to claim 7 and characterized further in that said means for controlling said compressing means and said means for selectively operating and evaporating means includes an overriding control means responsive to a predetermined value of said moisture content of said ambient air for said selectively operating said compressing means and evaporating means for maximum dehumidifying when said moisture content is greater than said predetermined value, overriding said temperature level range responsive means.

9. An air conditioning and dehumidifying system according to claim 1 and characterized further in that said means for evaporating refrigerant comprises a cooling coil for said air having a plurality of circuits communicating with said compressing means for reception of said refrigerant therefrom for normal comfort cooling of said ambient air at full capacity of said compressing means and means for selectively varying the number of said circuits communicating with said compressing means.

10. An air conditioning and dehumidifying system according to claim 9 and characterized further in that said means for selectively varying the number of said circuits comprises a first valve for blocking a portion of said circuits from communicating with said compressing means and a second valve for likewise blocking a larger portion of said circuits than said first valve.

11. An air conditioning and dehumidifying system according to claim 10 and characterized further in that said first valve is disposed in said circuits to block substantially 25% of said circuits and said second valve is disposed therein to block substantially 50% of said circuits.

12. An air conditioning and dehumidifying system according to claim 1 and characterized further in that said evaporating means operates at a surface temperature of about 45°-27° F. during said comfort cooling and at a surface temperature of about 34°-35° F. during said maximum dehumidifying.

13. An air conditioning and dehumidifying system according to claim 1 and characterized further by means for reheating said ambient air with waste heat from refrigerant during said maximum dehumidifying, and means responsive to said ambient air temperature for directing said waste heat to said reheating means when required for comfort heating.

* * * * *

UNITED STATES PATENT OFFICE

CERTIFICATE OF CORRECTION

Patent No. 4,189,929 Dated February 26, 1980

Inventor(s) Lillard G. Russell

It is certified that error appears in the above-identified patent and that said Letters Patent are hereby corrected as shown below:

In the "References Cited" on the first page, "2,461,602" should be --2,461,760--. Column 1, line 18, delete "commercial" and insert therefor --commercially--. Column 2, line 25, delete "front" and insert therefor --frost--. Column 2, line 53, delete "fo" and insert therefor --for--. Column 2, line 59, delete "capcity" and insert therefor --capacity--. Column 3, line 65, after "cooling" insert --coil--. Column 6, line 51, delete "plane" and insert therefor --panel--. Column 7, line 48, delete "ductowrk" and insert therefor --ductwork--. Column 8, line 43, delete "cne" and insert therefor --one--. Column 9, line 14, delete "meand" and insert therefor --means--. Column 9, line 54, after "characterized" insert --further--. Column 9, line 68, after "for" insert --said--. Column 10, line 37, after "operating", delete "and" and insert therefor --said--. Column 10, line 41, before "maximum" insert --said--. Column 11, line 4, delete "27°" and insert therefor --47°--.

Signed and Sealed this

*First* Day of *July 1980*

[SEAL]

*Attest:*

SIDNEY A. DIAMOND

*Attesting Officer*

*Commissioner of Patents and Trademarks*